United States Patent [19]

Ewing et al.

[11] 4,363,287

[45] Dec. 14, 1982

[54] PATTERN PRINTING CEMENTERS

[76] Inventors: Malcolm M. Ewing, East Rd., Atkinson, N.H. 03811; Alton R. Copithorne, Weathersfield St., Rowley, Mass. 01969

[21] Appl. No.: 145,011

[22] Filed: Apr. 29, 1980

[51] Int. Cl.[3] ..... B05C 1/02; B05C 13/02

[52] U.S. Cl. ..... 118/50; 118/212; 118/243

[58] Field of Search ..... 118/243, 263, 238, 253, 118/421, 50, 211, 212

[56] References Cited

U.S. PATENT DOCUMENTS

| | | | |
|---|---|---|---|
| 1,452,888 | 4/1923 | Marsh | 118/243 |
| 1,958,453 | 5/1934 | Urie | 118/243 X |
| 1,960,341 | 5/1934 | Keith | 118/263 X |
| 2,536,907 | 1/1951 | Brown | 118/253 X |

FOREIGN PATENT DOCUMENTS

| | | | |
|---|---|---|---|
| 500053 | 2/1939 | United Kingdom | 118/243 |

*Primary Examiner*—John P. McIntosh

*Attorney, Agent, or Firm*—Maurice R. Boiteau

[57] ABSTRACT

There is disclosed in the present application a cementing apparatus in which a pattern of cement is imprinted upon a part by an imprinting plate which, between imprinting operations, is submerged in a reservoir of cement. A part support, which cooperates with the plate, is shaped to receive the part or workpiece and is movable between loading and imprinting positions. The workpiece is retained by vacuum on the work support and is carried by it into contact with the plate, maintaining register so that the cement pattern is applied in a predetermined position on the workpiece.

10 Claims, 5 Drawing Figures

PATTERN PRINTING CEMENTERS

The present application relates generally to improvements in pattern cementing apparatus and more particularly to such apparatus in which the pattern of cement is applied by an imprinting element or plate.

In the manufacture of such articles as shoes, wallets, handbags and the like, many parts include areas which must be coated with cement as a step preliminary to edge folding without a seam and sometimes with a seam. The locally applied cement must be placed with a certain degree of precision since cement left on exterior surfaces of finished articles must either be removed with the expenditure of considerable labor or the article must be downgraded because of the defect. Conventional methods of applying cement locally are either by brush or spray, guided eifree hand or with a stencil. In either case, however, the process is inefficient, inaccurate and wasteful of both materials and labor.

It is accordingly an object of the present invention to improve both the economy and accuracy attending the application of cement to parts of various articles.

Another object is to increase the productivity of cementing operations at the same time that the skill required for performing the operation is reduced.

A further object is to provide greater economy in the use of materials in cementing operations.

The foregoing objects are achieved according to the present invention by a cementing apparatus in which a feature relates to a combination of a work support which locates the workpiece or part and a cement imprinting plate. The work support is movable between loading and imprinting positions. The work support receives the workpiece in its loading position and serves as a target which establishes the proper relative placement between the workpiece, held by vacuum on the support, and the imprinting plate so that the cement imprint is applied in the desired position with relation to the contour of the workpiece. The location of the cement imprint on the workpiece is obtained by locating the printing pattern on the plate in register with the work support while the work support is in the imprinting position.

According to another feature of the invention, the plate is submerged in a reservoir of cement between imprintings and is thus kept free of dried cement accumulations which interfere with the production of an accurate imprint. According to a related feature, the reservoir and plate are covered with a movable lid while no imprinting is being performed. The lid prevents the introduction of foreign matter and dust into the cement reservoir and also somewhat reduces the tendency of the upper surface of the cement reservoir to form a dried skin. Another benefit derived from the presence of the lid is the maintenance of the viscosity of the cement which effects the imprinting process as will later be seen.

The foregoing objects, features and numerous advantages flowing from the present invention will be more fully understood from the following detailed description of an illustrative embodiment taken in connection with the accompanying drawings on which:

Figure 1:
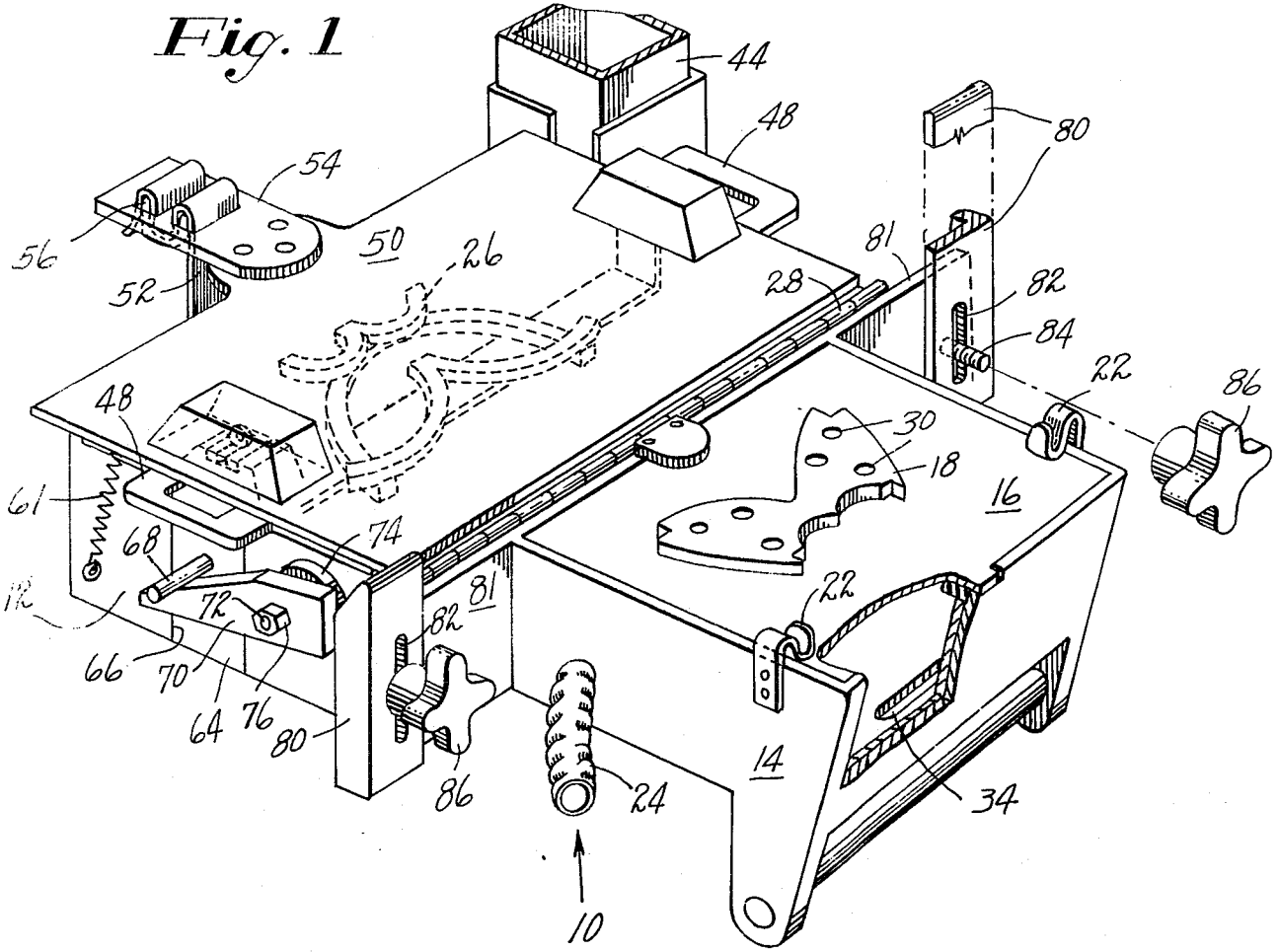
FIG. 1 is a view in perspective taken from the left front and showing a cementing apparatus according to the present invention.
Figure 4:
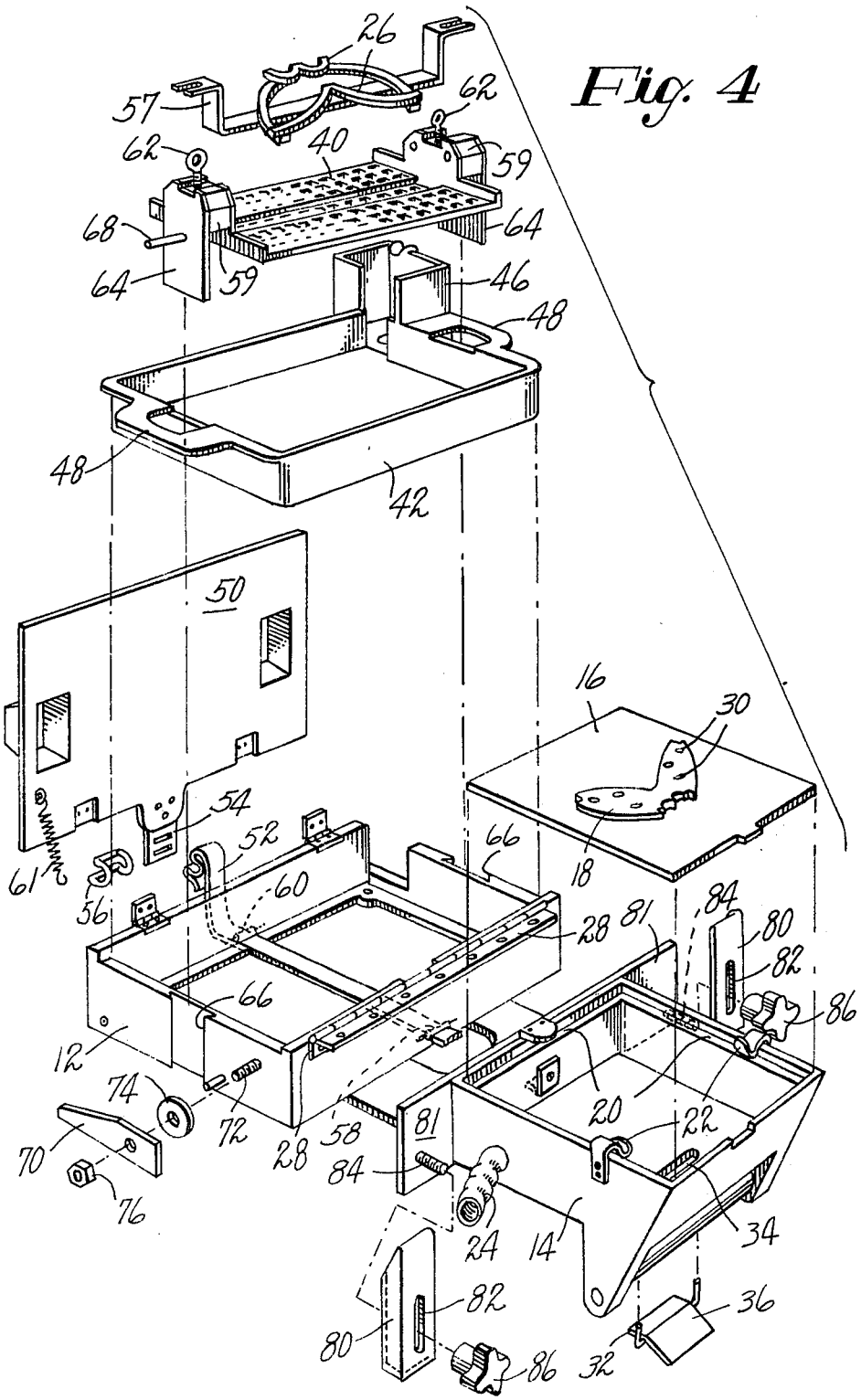
FIG. 4 is a view in perspective of the apparatus of the previous Figures but with the parts shown in exploded relationship for clarity.

Turning now to the drawings, particularly FIGS. 1 and 4, there is shown a cement pattern imprinting apparatus according to the present invention and indicated generally at 10. The apparatus 10 comprises a stationary base 12 in the form of a shallow box to the front edge of which is hingedly mounted a carrier 14. The top of the carrier 14 is closed by a panel 16 upon which is fixedly mounted a work support 18 nested in the top of the carrier 14 where it is clamped down on a peripheral shoulder 20 by a pair of spring clips 22. The carrier 14, closed by the panel 16, is connected to a source of vacuum through a hose 24 and is constructed as will later be seen to facilitate the placement of workpieces and their retention by vacuum to be brought into contact with an imprinting element or plate 26.

Figure 3:
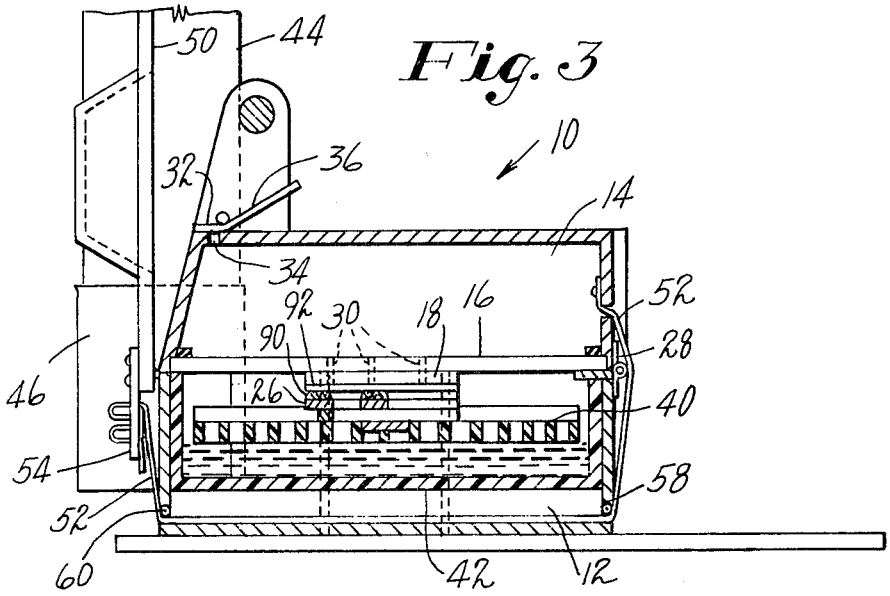
FIG. 3 is a view in transverse cross-section showing the apparatus of FIGS. 1 and 2 with its parts in the relative positions which they occupy at the time of imprinting a cement pattern upon a workpiece.

The apparatus 10 is designed to be operated manually, the only external form of power required being the source of vacuum already mentioned. Manual effort is applied by the operator by simply moving the carrier from the loading position depicted in FIG. 1 to the imprinting position shown in FIG. 3, the total motion imparted to the carrier being the pivotal motion about a hinge 28 which connects the carrier 14 to the base 12. The work support 18 is perforated at 30 to communicate with the interior of the carrier 14 which is under vacuum through the hose 24. A valve comprising a hinged flapper 32, shown in FIG. 3 is positioned to cover a series of openings 34 in the body of the carrier as the carrier is raised from its loading position shown in FIG. 1. The flapper 32 is formed with an integral upwardly extending tail 36 which, when the carrier is in the loading position of FIG. 1, causes the openings 34 to be uncovered, thereby reducing the vacuum in the carrier and allowing the workpiece being positioned on the work support to be moved into register with the work support. As the carrier is raised from the loading position, however, the flapper 32 under the influence of the vacuum in the carrier, closes the openings 34 to provide a greater force for retaining the workpiece on the work support to carry the workpiece into engagement with the imprinting plate while the carrier is in the position of FIG. 3.

The imprinting plate 26 is supported on a grid 40, normally submerged in a reservoir of cement contained in a liner or tray 42 fitted to the inside of the base 12. The tray 42 greatly facilitates the draining of cement from the present apparatus and necessary periodic cleaning prior to extended periods of non-use. For maintaining an adequate level of cement in the tray 42, it is provided with a reserve supply of cement in a container 44 upstanding in a lateral extension 46 of the main portion of the tray and in communication with the tray. The container 44 is fitted at its lower end with a flow regulator which automatically maintains the predetermined level of cement in the tray 42. For convenience in withdrawing the tray 42 from the base 12 either for emptying or for cleaning, the tray is formed with a pair of outwardly extending handles 50 and for emptying the tray, the extension 46 presents an excellent pouring spout.

The top of the base 12 is closed by a lid 50 which keeps the cement reservoir covered except when cement is to be applied to a workpiece. The lid 50 is hinged to the rear of the base 12 and a mechanism is provided for raising the lid out of the way as the carrier approaches. The mechanism includes a flexible strap 52 connected between the rear wall of the carrier 14 and a rearwardly directed extension 54 of the lid 50. The extension 54 is suitably perforated to receive the rearward end of the strap 52 and a sliding buckle 56 is provided to permit the strap to be adjusted by being drawn taut. From the rear wall of the carrier 12, the strap 52 is guided over rollers 58 and 60 at the front and rear of the base, passing, between the rollers, in a shallow recess in the bottom of the base. Thus, when the carrier 14 is pivoted upwardly from its loading position, the strap 52 is tightened, causing the lid 50 to be raised against the force of a tension spring 61 stretched between attachment points on the lid and the base to keep the lid closed.

Mechanism is also associated with the motion of the carrier 14 for raising the plate 26 from beneath the surface of the cement. The plate 26 is mounted on a narrow positioning adapter 57 dimensioned and shaped to fit slots in the grid 40 and in the tops of spacers 59, one secured to each end of the grid 40. The adapter 57 is formed with outwardly directed, perforated tabs, into the perforations of which are received thumbscrews 62 entering tapped openings in the slots in the tops of the spacers 60.

In plants where cementing operations are performed, it is a common practice to require the cementing of many parts having a wide variety of contours and requiring different cement patterns to be imprinted on them. The present arrangement already described allows great flexibility in the use of the apparatus and permits a quick changeover from one form of workpiece to another by simply replacing the adapter 58, the plate 26. The panel 16 and the work support 18, which make up a matched set of accurately registered and quickly replaceable parts.

The adapter 57 carrying the plate 26 is secured to the grid 40 and these parts move together as a unit as the carrier 14 is pivoted toward the imprinting position. In its motion, the assembly comprising the plate 26 is guided by a pair of slides 64 one fixedly depending from each end of the grid 40 outside the spacers 60. Each of the slides 64 is received in a dovetailed guideway 66 cut in one of the exterior end walls of the base 12. For actuating the motion of the grid 40, each of the slides 64 carries a follower pin 68 engaged by one arm of an operating lever 70 which is pivotally mounted on a stud 72 extending outwardly from the end wall of the base 12. The stud 72 is threaded into the end wall of the base and passes loosely through a suitable opening in the lever 70, a spacer 74 being interposed between the lever and the outside wall of the base and a nut 76 being employed to retain the lever on the stud.

For raising the grid 40 and the associated parts, each of the levers 70 is engaged by an upstanding adjustable finger 80, mounted on a lateral extension of the rear wall of the carrier 14. Each of the fingers 80 is of an L-shaped cross-section and is slotted at 82 to receive a threaded stud 84 on which it is clamped by a tapped hand knob 86, the fingers being positioned to engage the levers 70 as the carrier is moving toward the imprinting position and thereby cause the grid 40 to rise out of the cement reservoir carrying the plate 26 to imprint its cement pattern upon the workpiece.

Figure 5:
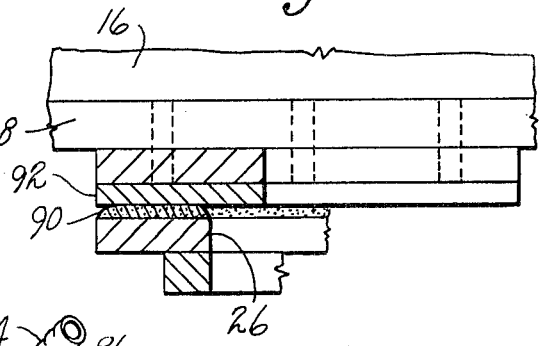
FIG. 5 is a detail view in cross section and on an enlarged scale showing relative positioning of a work support and an imprinting plate forming part of the present apparatus, and also showing the workpiece receiving a cement imprint from the plate.
Figure 2:
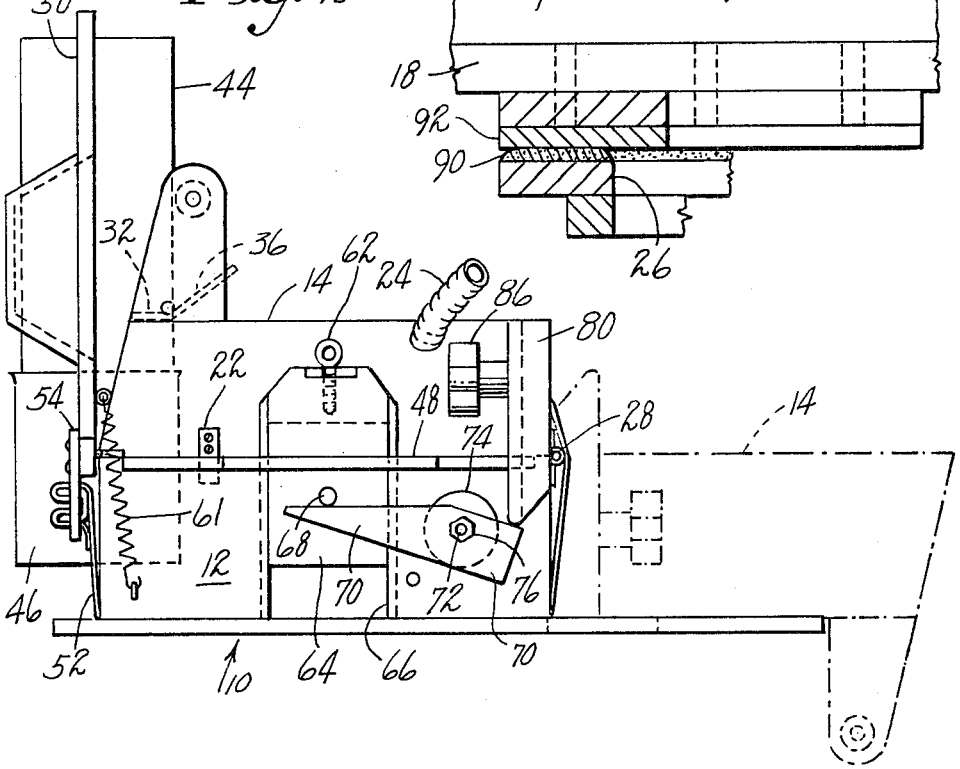
FIG. 2 is a view in left side elevation of the apparatus depicted in FIG. 1.

The adjustment of the fingers on the lateral extensions 81 and the corresponding height of the plate 26 in its imprinting position is important because of the manner in which the cement is applied to the workpiece in the present apparatus, as will be explained with reference to FIG. 5. The imprinting of the cement pattern, unlike the making of an ink impression in a normal printing process carried out on a letter press, for example, is accomplished by merely touching the workpiece to the cement rather than by the application of heavy pressure to the workpiece with the imprinting instrumentality. As best seen in FIG. 5, a quantity of cement or charge 90 has been picked up by the plate 26 from being submerged in the cement of the tray 42 and is being applied to a workpiece 92 held by the work support 18. The charge 90 is shown exaggeratedly to retain considerable thickness with the workpiece 92 and the plate 26 having reached their closest relative positions. Although the thickness of the charge 90 is exaggerated for clarity, it will be appreciated that the height reached by the plate is adjusted through the position the fingers 80 so that the cement charge is never squeezed between the plate 26 and the workpiece. The result of squeezing the charge between the plate 26 and the workpiece is to extrude droplets onto the workpiece. The squeezing of the charge 90 is avoided by the correct relative placement of the plate 26 and of the work support 18 in their imprinting positions, achieved by the adjustment of the fingers 80. The correct spacing between the imprinting plate 26 and the work support depends upon the thickness of the workpiece and the viscosity of the cement. It has been found that the greater the viscosity of the cement, the thicker the charge 90. Since the thickness of the workpiece remains constant for a given run, the only variable affecting the quality of the cement impression on the workpiece is the viscosity of the cement. In order to reduce the need for correcting the viscosity of the cement at frequent intervals or to compensate for uncorrected changes, the importance of the lid 50 will be more fully appreciated.

From the accompanying drawings and from the foregoing description, numerous variations and modifications within the scope of the invention will be obvious to those of ordinary skill in the art. It is therefore not intended that the foregoing be taken as a limitation of the scope of the invention but rather that the invention be interpreted in terms of the appended claims.

Having thus disclosed our invention, what we claim as new and desire to secure by Letters Patent of the United States is:

1. Apparatus for imprinting a pattern of cement upon an irregularly shaped workpiece, comprising a base containing a quantity of cement, a work support contoured at least in part to match the contour of the workpiece and providing a target for the placement of the workpiece, an imprinting plate normally submerged in the cement and shaped to apply a pattern of cement only to a pre-determined area of the workpiece when it is raised out of the cement to an imprinting position, a carrier hinged directly upon the base and upon which the work support is mounted for movement between a loading position where the workpiece is adjustably received and an imprinting position in which the work support is in register with the imprinting plate and in which the workpiece on the work support is brought into contact with cement carried by the imprinting plate, means coupling the carrier and the imprinting plate together for causing the imprinting plate to rise above the level of the cement as the work support pivotally approaches the imprinting position and to be submerged as the work support is returned to its loading position, and vacuum means for retaining the workpiece on the work support.

2. Apparatus according to claim 1 further comprising means for varying the vacuum at the work support to a low level at the loading position to permit the workpiece to be manually aligned on the support and to a higher level to assure retention of the workpiece on the support during an operating cycle of the apparatus after the support is moved from its loading position.

3. Apparatus according to claim 1 further characterized in that the carrier is hollow and that its shape and hinge mounting on the base cause the work receiving surface of the support to be uppermost and horizontal in its loading position and that the vacuum means is connected to the work support through the carrier.

4. Apparatus according to claim 3 further comprising a valve means on the carrier for varying the vacuum at the work support from a low level permitting the workpiece to be manually aligned on the support at the loading position to a high level for securely retaining the workpiece on the support after the support is moved from the loading position.

5. Apparatus according to claim 1 further comprising means for adjusting the spacing between the work support and the imprinting plate when both are in their imprinting positions.

6. Apparatus according to claim 1 further comprising a lid pivoted on the base and normally covering the cement and means interconnecting the lid and the carrier for raising the lid as the carrier is pivoted manually to bring the work support into its imprinting position.

7. An interchangeable sub-assembly for providing a target for an irregularly shaped workpiece and for imprinting a pattern of cement in a pre-determined area of the workpiece in an apparatus including a base containing a quantity of cement, a grid submersible in the cement and having locating means for receiving an adapter, and also including a carrier formed with a nest and mounted for movement toward and away from the grid, the sub-assembly comprising an imprinting plate, an adapter associable with the locating means and upon which the plate is fixedly mounted for positioning the plate on the grid, a work support contoured at least in part to match the workpiece and thereby to provide a target for positioning the workpiece and a panel upon which the work support is fixedly mounted, the panel being receivable in the nest to align the work support in register with the imprinting plate when both the work support and the plate are in imprinting relationship whereby a different subassembly is employed for each workpiece contour and cement pattern.

8. A manually actuated apparatus for imprinting a pattern of cement upon an irregularly shaped workpiece, comprising a base containing a quantity of cement, an imprinting plate normally submerged in the cement and shaped to apply a pattern of cement only to a pre-determined area of the workpiece when the plate is raised out of the cement to an imprinting position, a carrier hinged directly upon the base, a work support fixedly mounted on the carrier and contoured at least in part to match the contour of the workpiece to provide a target for establishing a pre-determined position for the workpiece, the carrier being manually movable between a loading position for the work support and an imprinting position in which the workpiece is brought into contact with cement carried by the plate in its imprinting position, vacuum means for retaining the workpiece on the work support and means interconnecting the carrier and the plate for causing the plate to be raised out of the cement to its imprinting position solely from the manual pivotal movement of the carrier bringing the work support to its imprinting position.

9. Apparatus according to claim 8 further comprising a lid normally covering the cement in the base and means interconnecting the carrier and the lid to raise the lid out of the way as the work support approaches, the movement of the lid being actuated solely from the manually actuated movement of the carrier.

10. Apparatus according to claim 8 further comprising a valve on the carrier controlling the vacuum to a low level permitting the placement of the workpiece on the work support in the loading position, the valve being closed by the displacement of the carrier from the loading position to raise the vacuum level for retaining the workpiece securely on the work support.

* * * * *